United States Patent [19]

Ferguson

[11] Patent Number: 4,993,514

[45] Date of Patent: Feb. 19, 1991

[54] LADDER LEVELLING DEVICE

[76] Inventor: William H. Ferguson, 18 Graham Crescent, Bainfield Estate, Cardross, Dunbartonshire, Great Britain, G82 5Jh

[21] Appl. No.: 435,475

[22] PCT Filed: Jun. 24, 1988

[86] PCT No.: PCT/GB88/00493

§ 371 Date: Nov. 27, 1989

§ 102(e) Date: Nov. 27, 1989

[87] PCT Pub. No.: WO88/10354

PCT Pub. Date: Dec. 29, 1988

[30] Foreign Application Priority Data

Jun. 24, 1987 [GB] United Kingdom ..... 8714831

[51] Int. Cl.[5] ..... E06C 7/44

[52] U.S. Cl. ..... 182/200

[58] Field of Search ..... 182/200–205, 182/107, 111; 248/188.2, 188.3

[56] References Cited

U.S. PATENT DOCUMENTS

| | | | |
|---|---|---|---|
| 1,088,167 | 2/1914 | Osterhoudt | 182/200 |
| 1,424,934 | 8/1922 | Paterson | 182/200 |
| 2,971,602 | 2/1961 | West | 182/200 |
| 3,199,629 | 8/1965 | Fagaly | 182/200 |
| 3,233,702 | 2/1966 | Feltrop . | |
| 4,243,122 | 1/1981 | Coutts . | |
| 4,456,095 | 6/1984 | Hodson | 182/200 |

FOREIGN PATENT DOCUMENTS

| | | |
|---|---|---|
| 3010142 | 9/1981 | Fed. Rep. of Germany . |
| 3529040 | 2/1987 | Fed. Rep. of Germany . |
| 1520525 | 4/1968 | France . |
| 2120599 | 8/1972 | France . |
| 736400 | 9/1955 | United Kingdom . |

*Primary Examiner*—Reinaldo P. Machado

*Attorney, Agent, or Firm*—Bell, Seltzer, Park & Gibson

[57] ABSTRACT

A ladder safety device includes a carrier structure capable of attachment to a ladder so as to carry the feet of the ladder. The carrier structure incorporates fixedly mounted first interconnect device, ground-engaging feet devices, and linkage arrangement connected to the ground-engaging feet devices and includes a second interconnection which is capable of releasably interconnecting with the first interconnect device to enable verticality of a ladder when the ground-engaging devices engage an inclined surface. Rigidity between the ground-engaging devices and the carrier structure is provided by interconnection of the first and second interconnect devices.

6 Claims, 1 Drawing Sheet

LADDER LEVELLING DEVICE

This invention relates to a ladder levelling device.

According to the present invention a ladder levelling device is characterised by the combination of a carrier structure capable of attachment to a ladder and adapted releasably to receive the feet of the ladder in a sliding fit at spaced apart stations on the structure, said structure incorporating fixedly mounted first interconnect means extending substantially linearly between said stations, first and second adjustably mounted ground-engaging means, and articulated linkage means connected to the first and second ground-engaging means and including second linearly extending interconnect means for releasably interconnecting with said first interconnect means, said second interconnect means extending parallel to said first interconnect means, each of said interconnect means comprising interconnect elements capable of connecting the second interconnect means to the first interconnect means at a selected one of a plurality of locations along the length of the first interconnect means, wherein the linkage means is resiliently biassed against said interconnection being effected in the absence of ladder weight being applied to said carrier structure, whereby to permit by selective interconnection of the first and second interconnect means verticality of a ladder when the ground-engaging means are supported by an inclined surface, with rigidity between the ground-engaging means and the carrier structure provided by said interconnection of the first and second interconnect means.

The first and second interconnect means may each take the form of a toothed rack or one may take the form of a rack whilst the other may take the form of a member having at least one tooth which is interengageable with the rack. Alternatively, one may take the form of a member defining a series of sockets whilst the other is in the form of a member having at least one spigot. A still further alternative is for one to take the form of a member defining a series of spigots whilst the other is in the form of a member having at least one socket.

Preferably the linkage means includes a stop member which, in the absence of ladder weight, supports the second interconnect member.

Preferably said first interconnect means and said second interconnect means each extend generally horizontally when the device is in use, the first interconnect means being substantially at right angles to the length of the ladder.

Preferably said ground-engaging means comprises a pair of feet members each pivotally mounted on the lower portion of the carrier structure. Alternatively the ground-engaging means may comprise a pair of feet members each slidably mounted on the carrier structure.

Preferably the carrier structure is of box-like configuration dimensioned to receive the ladder feet in a sliding fit.

Preferably the carrier structure incorporates clamp means for clamping to the ladder. The clamp means may clamp to the ladder feet or to a ladder rung or tread.

An embodiment of the present invention will now be described by way of example with reference to the accompanying drawing, in which.

Figure 3:
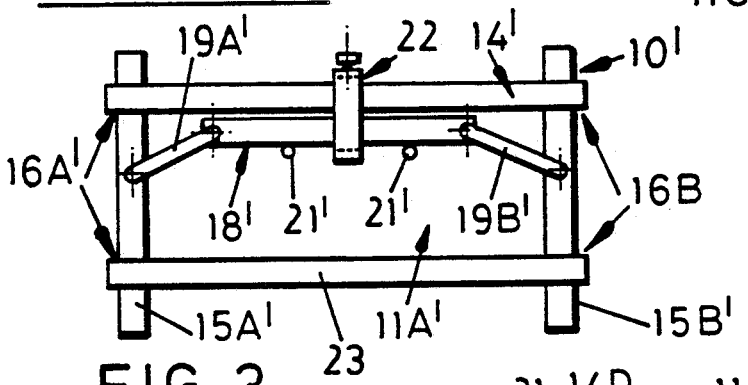
Figure 4:
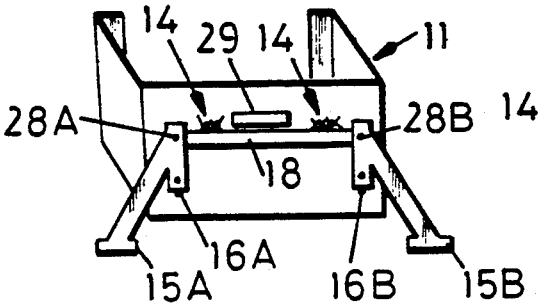
Figure 5:
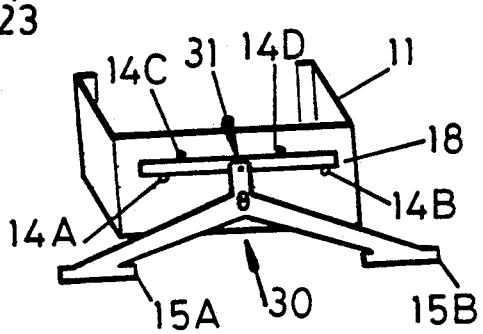

FIGS. 3, 4 and 5 schematically illustrate alternative versions of ladder levelling devices.

As is shown in the drawings a ladder levelling device 10 comprises a box-like carrier structure 11 having a front panel 11*a*, side panels 11B and a truncated rear panel 11C, the side panels being braced by a bar 12 which forms a platform for supporting the feet of a ladder (not shown) in the regions where the bar 12 meets with the side panels 11B, the depth and spacing of the panels 11B of the structure 11 being dimensioned to receive the ladder feet in a sliding fit.

Figure 1:
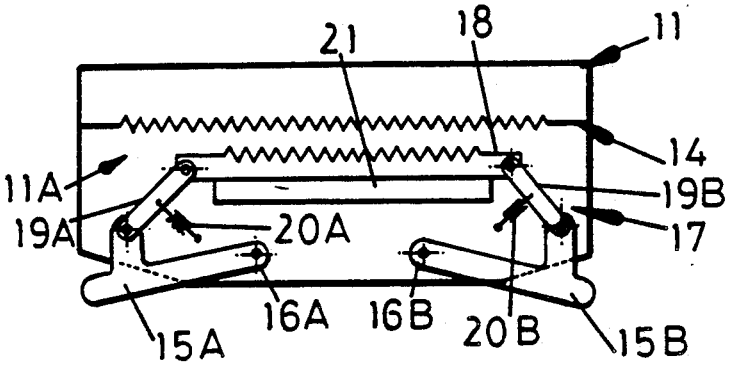
FIG. 1 is a front view of a device according to the present invention.
Figure 2:
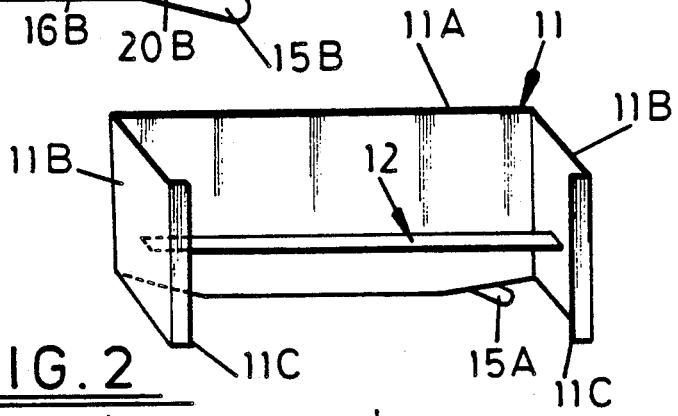
FIG. 2 is a rear pictorial view of the FIG. 1 device.

As is shown in FIG. 1 the structure 11 has an upper portion to which is affixed a toothed rack 14 the teeth of which extend horizontally and are downwardly presented. The lower portion of the structure 11 supports ground-engaging means in the form of a pair of feet members 15A, 15B, each pivotally mounted at 16A, 16B, to enable variable inclination of the ground-engaging means with respect to the upper portion of the structure 11. Toothed linkage means 17 releasably interconnect the ground-engaging means with the fixed rack 14, means 17 including a toothed link member 18 with horizontally extending teeth which are upwardly presented and which, in use, engage with the teeth of the fixed rack 14. Member 18 is connected by pivotally mounted links 19A, 19B, to the respective feet members 15A, 15B, each of the links 19A, 19B, being resiliently biassed by respective springs 20A, 20B, to hold the link member 18 against a stop member 21 secured to the lower portion of the structure 11 so that there is an absence of engagement between link member 18 and rack 14 in the absence of ladder weight being applied to the structure 11.

The feet members 15A, 15B: may incorporate enlarged ground-engaging portions in order to reduce the applied pressure when the device is in use.

When the levelling device 10 is in use and weight is applied via the ladder to the structure 11 feet members 15A, 15B, in mechanical reaction with the ground or other supporting structure pivot and cause member 18 to move away from stop member 21 into engagement with the fixed rack 14, the tooth-to-tooth interengagement providing rigidity to the device 10. When the ground-engaging means formed by feet members 15A, 15B, are supported by an inclined surface vertically of the ladder is achieved by lateral movement of member 18 with respect to the fixed rack 14 prior to enmeshing of the teeth, this being achieved automatically by hand manipulation of the ladder axis and intermittent release of the ladder weight from the structure 11 which, in turn, permits intermittent release of the enmeshing teeth and lateral movement of member 18 under the influence of one of the foot members 15A, 15B against the ground.

It will be appreciated that springs 20A, 20B form a resilient biassing means but that this need not be in the form of springs as illustrated. Furthermore although the pitch of the teeth on link member 18 requires to match that of the teeth on rack 14 to permit enmeshing the shape of the teeth on member 18 need not be exactly the same on components 14 and 18. For example, the teeth on rack 14 may be provided with offset apices to reduce the possiblity of apex to apex jamming which although existing with a small probability level is desirably minimised in the interest of safety.

In another modification the tooth racks are replaced with members defining pin and socket interconnections and the protruding ends of the pins may be coned or domed to facilitate entry into the sockets. The feet members may incorporate individual extension pieces providing extension in either or both of the vertical and horizontal directions, these extension pieces being connected to the feet members by clamps. The stop member 21 may be replaced with a pair of spaced roller elements which, together function as a stop member for the moving member 18. Springs 20A, 20B may act indirectly on the linkage means 17, for example, by biassing roller elements against the upper surface of the member 18.

In the version of the device 10' illustrated in FIG. 3 the structure 11 with its front panel 11A' is provided with slidably mounted feet members 15A', 15B', by virtue of mountings 16A', 16B', formed by lateral extension of fixed member 14' at the top of the structure and by a member 23 at the bottom of the structure. Links 19A', 19B', interconnect feet members 15A', 15B', with movable member 18' which is supported by rollers 21'. The mating surfaces of members 18', 14' in this instance are friction surfaces and rigidity of interconnection is assured by a hand operated clamp 22 which is mounted on the structure 11. Operation of device 10' is essentially the same as that of device 10.

In the FIG. 4 form of the device feet members 15A, 15B are mounted by pin and slot connections 16A, 16B on the structure 11 and are interconnected by bar member 18 by pin joints 28A, 28B, member 18 being capable of sliding laterally with respect to a guide member 29 fixedly secured to the structure 11. Interengagement between toothed members 14 and 18 occurs when the device is in use by virtue of the pin and slot connection 16A, 16B the slots of which are formed in the carrier 11 and extend vertically, which is orthogonally with respect to member 18.

In the FIG. 5 form of the device the feet members 15A, 15B are united and mounted on the carrier 11 by a single pin and slot connection 30, the pin being carried by the carrier 11. The members 15A, 15B are also pivotally connected to bar member 18 which is capable of sliding laterally with respect to stud members 14A, 14B secured to the carrier. Toothed members 14C, 14D interengage with toothed parts of member 18 to provide security.

The levelling device which has been described also finds use with a ladder in the form of a stepladder in which case it can be used either on the front feet formed by a tread-carrying styles or on the rear feet.

I claim:

1. A ladder levelling device is characterised by the combination of a carrier structure capable of attachment to a ladder and adapted releasably to receive the feet of the ladder in a sliding fit at spaced apart stations on the structure, said structure incorporating fixedly mounted first interconnect means extending substantially linearly between said stations, first and second adjustably mounted ground-engaging means and articulated linkage means connected to the first and second ground-engaging means and including second linearly extending interconnect means for releasably interconnecting with said first interconnect means, said second interconnect means extending parallel to said first interconnect means, each of said interconnect means comprising interconnect elements capable of connecting the second interconnect means to the first interconnect means at a selected one of a plurality of locations along the length of the first interconnect means, wherein the linkage means is resiliently biassed against said interconnection being effected in the absence of ladder weight being applied to said carrier structure whereby to permit by selective interconnection of the first and second interconnect means verticality of a ladder when the ground-engaging means are supported by an inclined surface, with rigidity between the ground-engaging means and the carrier structure provided by said interconnection of the first and second interconnect means.

2. A ladder levelling device as claimed in claim 1, characterised in that the first and second interconnect means each take the form of a toothed rack.

3. A ladder levelling device as claimed in claim 1, characterised in that one of said interconnect means defines a series of sockets and the other defines at least one spigot which is interengageable with the sockets.

4. A ladder levelling device as claimed in claims 1, 2 or 3, characterised in that said ground-engaging means are pivotally mounted on the lower portion of the carrier structure.

5. A ladder levelling device as claimed in claims 1, 2 or 3, characterised in that the ground-engaging means are slidably mounted on the carrier structure.

6. A ladder levelling device as claimed in claim 1, characterised in that the carrier structure incorporates clamp means for clamping to the ladder.

* * * * *